US007131619B2

(12) United States Patent
Krapf et al.

(10) Patent No.: US 7,131,619 B2
(45) Date of Patent: Nov. 7, 2006

(54) ROTATABLE DISPLAY APPARATUS

(75) Inventors: Wallace A. Krapf, Macedon, NY (US); Daniel W. Rossborough, Victor, NY (US)

(73) Assignee: W.A. Krapt, Inc., Macedon, NY (US)

( * ) Notice: Subject to any disclaimer, the term of this patent is extended or adjusted under 35 U.S.C. 154(b) by 0 days.

(21) Appl. No.: 10/834,296

(22) Filed: Apr. 28, 2004

(65) Prior Publication Data

US 2005/0242262 A1 Nov. 3, 2005

(51) Int. Cl.
*F16M 13/00* (2006.01)

(52) U.S. Cl. ..... 248/415; 40/431

(58) Field of Classification Search ..... 248/127, 248/415, 158, 469; 40/431, 473, 505, 502, 40/501, 606.14
See application file for complete search history.

(56) References Cited

U.S. PATENT DOCUMENTS 3,654,716 A * 4/1972 Moss ..... 40/473
4,978,948 A * 12/1990 Samen ..... 340/690
5,046,274 A * 9/1991 David ..... 40/604
5,297,353 A * 3/1994 Ghalayini ..... 40/503
5,315,776 A * 5/1994 Strawbridge et al. ..... 40/505
5,479,153 A * 12/1995 Yi et al. ..... 340/815.87
5,545,958 A * 8/1996 Kramer ..... 318/560
5,562,459 A * 10/1996 Durlach ..... 434/402
6,018,899 A * 2/2000 Hanitz ..... 40/473
6,571,495 B1 * 6/2003 Margaronis ..... 40/473

FOREIGN PATENT DOCUMENTS

GB GB 2226438 A * 6/1990

* cited by examiner

*Primary Examiner*—A. Joseph Wujciak
(74) *Attorney, Agent, or Firm*—Peter J. Bilinski

(57) ABSTRACT

A display apparatus includes a stationary base portion and a support member mounted to a top surface of the stationary base portion. A vertically extending pole is disposed through the interior of each of the support member and the base portion along a center axis, thereby permitting selective rotation of the support member. The support member includes a plurality of lateral side panels for displaying graphic and or other materials, such as photographs and advertising. The vertically extending pole permits electrical leads to be routed therethrough to connect, for example, to at least one light source.

26 Claims, 5 Drawing Sheets

ROTATABLE DISPLAY APPARATUS

FIELD OF THE INVENTION

This invention relates to the field of displaying articles, and more specifically to a rotatable display apparatus that is capable of displaying or supporting a plurality of graphic and other media and/or advertising materials for display.

BACKGROUND OF THE INVENTION

It is known in the field to provide certain forms of display upon which graphic media materials such as articles, photographs, and other textual and/or pictorial items can be displayed or presented. Such displays have proven useful for groups or gatherings including, for example, weddings, bowling and golf tournaments and leagues, corporate functions and outings, and the like. These displays typically include a single planar facing surface onto which any of the above items can be affixed, thereby taking up a considerable amount of floor space. Such displays, to date, include apparatus such as bulletin boards and the like. Similar displays, used for example, for advertising or for functional purposes, such as scheduling or calendaring, among others. The issues relating to available floor space equally pertain to each of the above displays.

Applicant has previously developed a rotatable form of display apparatus or kiosk in which a cubic supporting member having a plurality of orthogonally arranged display panels is installed onto a fixed or stationary base section. This display apparatus efficiently makes better use of floor space than other existing systems, while simultaneously providing an enhanced amount of overall display space. The base section of the apparatus is fabricated from several sections, including a turntable that is mounted integrally into a top supporting surface onto which the cubic supporting member is attached, permitting selective rotation thereof by the user(s). Each of the sides of the cubic supporting member includes a display panel that is capable of supporting certain graphic media, such as photographs and the like.

There are a number of deficiencies, however, that are found even in the latter apparatus design. First, the use of the turntable and other components add to the overall weight and complexity of the apparatus, making the apparatus an expensive design in terms of both cost and manufacture. Second, the incorporation of the turntable is a source of noise in terms of operation when the support member is actually rotated. Third, there is a need to expand the capabilities of the present display apparatus design.

SUMMARY OF THE INVENTION

It is therefore a general need in the field and a primary object of the present invention to provide an improved display apparatus.

It is a further object of the present invention to provide a display apparatus that is easier and less complex to manufacture than previously known display apparatus, but that provides enhanced capabilities.

It is yet a further object of the present invention to provide a display apparatus that permits illumination and other electrically powered components to be added without significant modification or expense.

Therefore and according to a preferred aspect of the present invention, there is disclosed a display apparatus for graphic and other media materials, said apparatus comprising:

a base portion;

a support member mounted to a top surface of said base portion; and means for permitting said support member to be rotated about a center axis of said apparatus, said rotation means including at least one vertically extending member disposed through the interior of said base portion and said support member along the center axis thereof, said at least one vertically extending member being supported to said support member and said base portion at either end thereof to permit said support member to be rotatable about said center axis.

According to another preferred aspect of the present invention, the vertically extending member comprises a pole that includes means for routing or otherwise supporting a number of electrical leads such as, for example, from a power supply, permitting the inclusion of at least one lamp, LED or other light source at the top or other convenient part of the support member. For example, a sign can be separately attached to the top of the apparatus, the sign having at least one illuminated portion thereof for advertising or other purposes that can be energized by means of the above lead connection. In a preferred embodiment, the pole includes at least one slot or is formed as a hollow component in order to permit the passage of the electrical leads therethrough. Alternatively, the illuminated sign can be placed elsewhere on the herein described display apparatus, such as within the base portion, or a sign(s) can be separately affixed to the support member or other portions of the apparatus.

The herein described display apparatus can further include at least one electric motor, preferably housed within the confines of the stationary base portion, which serves to selectively rotate the support member, as needed, and/or supply power for illumination.

The base portion of the herein described display apparatus is stationary and is preferably hollow and can be made from a lightweight plastic material that can be formed into a unitary member, thereby simplifying manufacture. Additionally, this unitary portion can be made from a translucent or colored material to permit light transmission, for example, backlighting.

An advantage of the present invention is that a number of different display panels can be selectively rotated, either manually or automatically, each of the panels having differing means for supporting different forms of graphic media material. The support member can preferably assume a number of geometric configurations. According to the herein described embodiments, the member is cubic in configuration, containing four (4) lateral or side display panels, but it should be understood that this number can easily be varied depending on the application. Furthermore, it will also become readily apparent that the herein described support member can assume a variety of shapes such as circular (e.g., cylindrical), rhombic, trapezoidal, triangular, other polyhedral configurations and the like. According to yet another preferred embodiment, the display panels can be directly and separately attached to the vertically extending pole wherein the pole can include a core portion having a configuration that permits attachment thereto. For example, the core portion can be square or round in cross section.

According to another embodiment, at least one of display panels can be separately hinged to the support member or directly to the vertically extending member, permitting the panels to open in a leaf-like fashion, and maximizing available display space in a small area.

A further advantage of the present invention is that the display apparatus can be made more efficiently with fewer parts than previously known versions. Moreover, the ability to rout electrical leads through the herein described display apparatus significantly expands the number of uses thereof.

These and other objects, features and advantages will become readily apparent from the following Detailed Description which should be read in conjunction with the accompanying drawings.

DETAILED DESCRIPTION

The following description relates to a number of embodiments of a rotatable display apparatus or kiosk that is made in accordance with the present invention. Throughout the discussion that follows a number of terms are used such as "top", "bottom", "lateral", "side" and the like. These terms are not intended to be over limiting of the present invention and are intended merely to provide a frame of reference with regard to the accompanying drawings.

Figure 1:
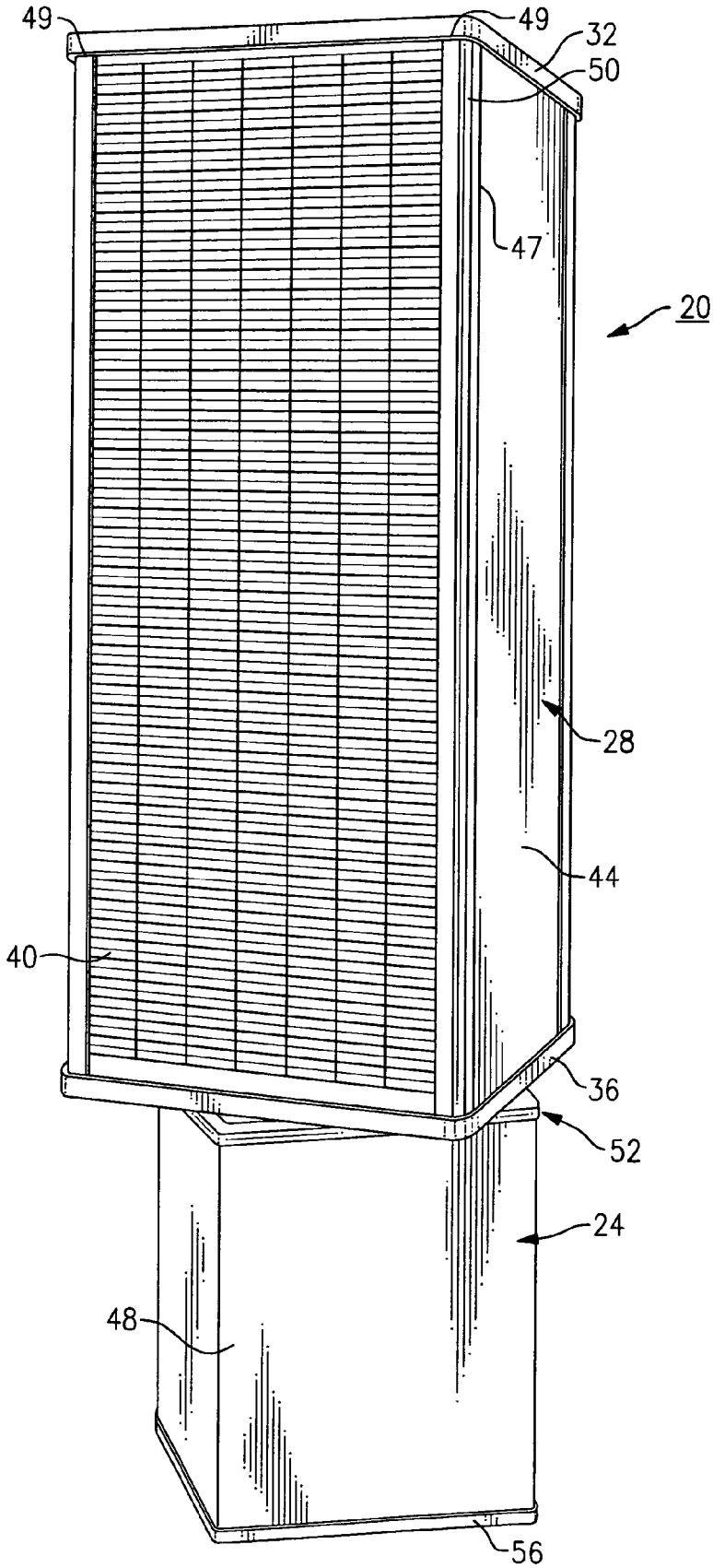
FIG. 1 is a front perspective view of a display apparatus that is made in accordance with a first embodiment in accordance with the present invention.

Referring to FIG. 1, the rotatable display apparatus 20 is defined by two primary components, namely a stationary or fixed base portion 24, as well as a support member 28 that is mounted onto the top of the stationary base portion and is supported for rotation thereupon, as described in greater detail below.

The support member 28, according to this embodiment, is cubic in configuration having an overall aspect ratio that includes height to width of approximately 4:1 in terms of height to width though this parameter can be selectively varied, depending on the application of use. According to the present embodiment, the support member is approximately 76" (inches) in height and approximately 19" in width. The support member 28 defined herein is further defined by a pair of covers; namely a top cover 32 and a bottom cover 36, as well as four lateral or facing side panels (only two of the panels 40, 44 being shown) that covers an interior. Additionally, the number of facing side panels 40, 44 can be varied, meaning that the support member can assume a varied number of shapes or design configurations. For example, the support member 28 can be polyhedral, thereby having any convenient number of sides, or alternatively can be circular, though the latter configuration does not necessarily provide for large savings in storage space. The latter may be more useful, however, for advertising purposes. In the present embodiment, the total display space taken by the facing side panels is approximately equivalent to that of a 4'×6' board display, while being situated in a floor space of 23"×23", that is, the diameter of the circle formed by the rotating support member 28. Each of the side panels 40, 44 are attached to one another by means of a plurality of vertically extending sections 47, each of the sections having a pair of slots 49 for permitting the attachment to the edges of corresponding side panels 40, 44. The vertically extending sections 47 further provide an inwardly cupped portion 50 to permit the apparatus to be easily rotated by the user, the inwardly cupped portion being sized in order to permit the fingers of the user to easily maintain a stable hold upon the support member 28.

The stationary base portion 24 of the herein described display apparatus 20 is also preferably defined by a substantially cubic configuration, though having a significantly smaller aspect ratio of about 1.3 to 1 in terms of height to width though this parameter also can easily be varied. According to the present embodiment, the base portion has a height of approximately 28 inches. Preferably, a unitary molded plastic section 48 forms each of the side or lateral walls of the base portion 24, the base portion also having respective top and bottom covers 52, 56 that are attached to respective open ends of the unitary section 48. The unitary section 48, for example, can be made from a translucent material to permit backlighting.

Figure 2:
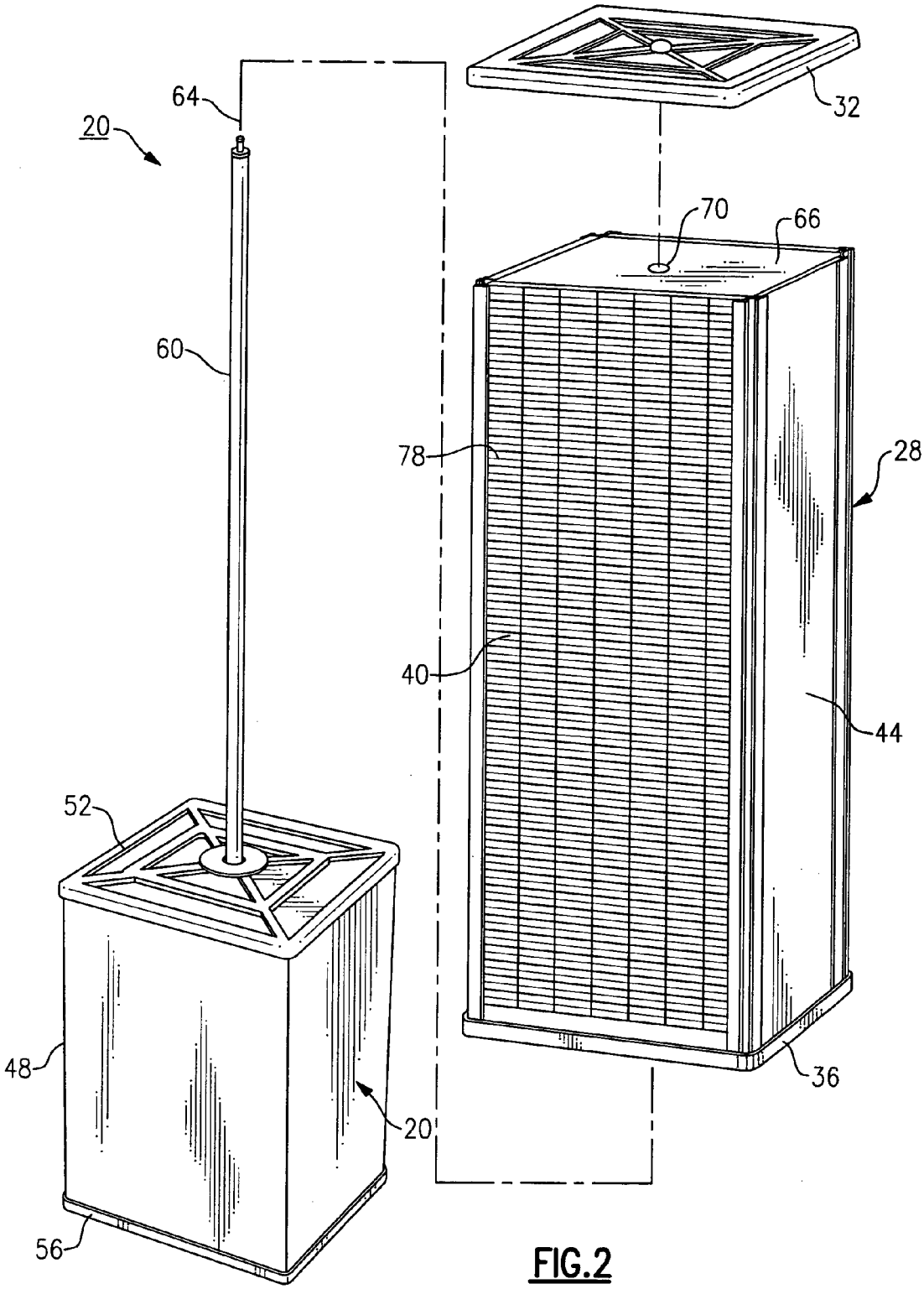
FIG. 2 is a partially exploded view of the display apparatus of FIG. 1.

Referring to FIG. 2, the display apparatus 20 further includes a vertically disposed pole 60 that extends through the interiors of each of the stationary base portion 24 and the cubic support member 28. An intermediate top panel 66, preferably made from wood or other structural material, is interposed between the top cover 32 and the hollow interior of the support member, this panel being used to distribute the weight of the support member 28, wherein a fastener (not shown in this figure) used to connect the pole 60 to the support member 28 extends through an opening 70. A similar intermediate bottom panel 74, FIG. 4, is provided between the bottom cover 53 of the base portion 24 and the interior thereof in order to distribute weight effectively and to enable attachment of the pole 60, as will now be described in greater detail.

Figure 3:
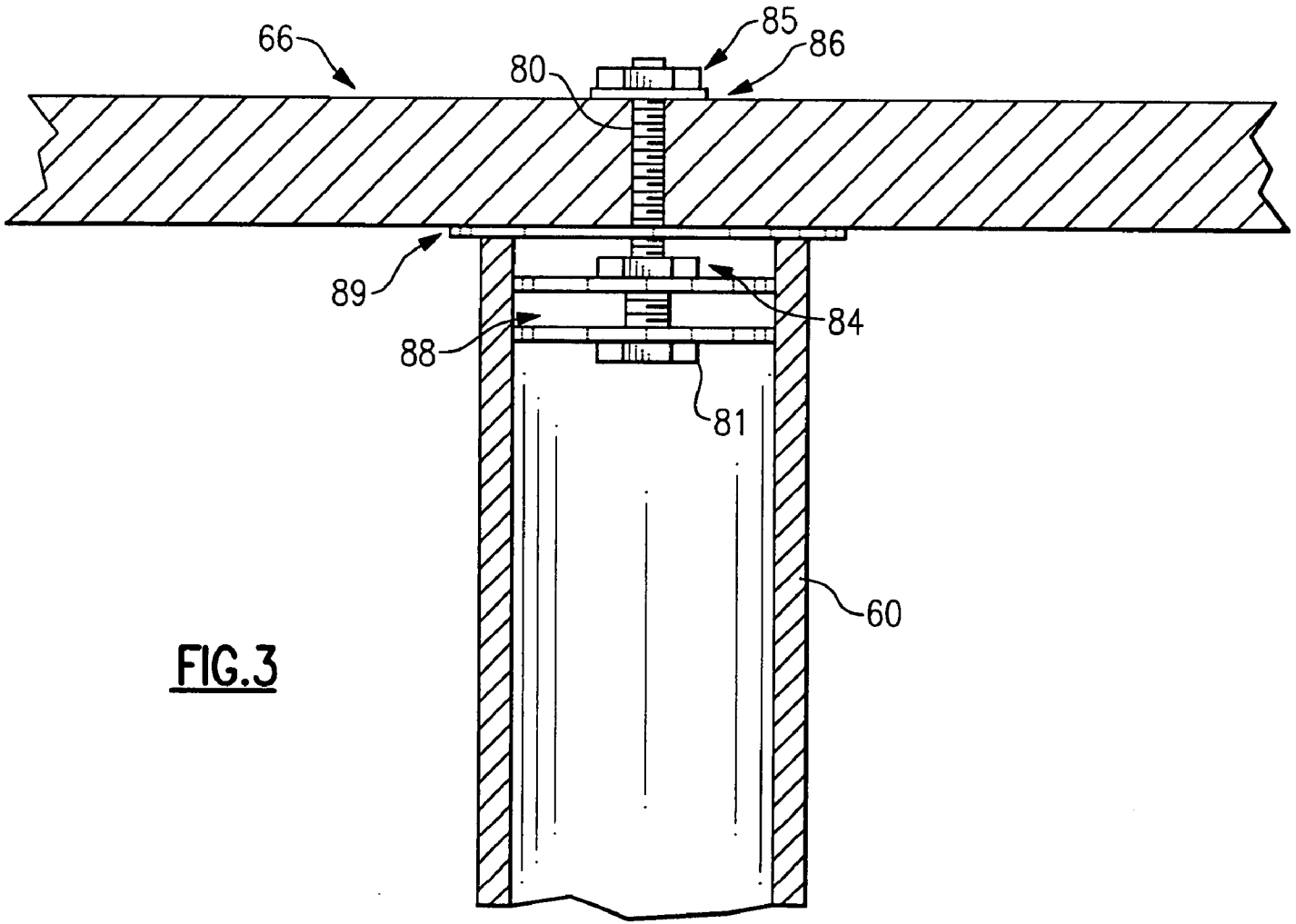
FIG. 3 is a sectioned view illustrating the attachment of the vertically extending member relative to the top of the support member of the display apparatus of FIGS. 1 and 2.

The pole 60 is fixedly anchored at each of its opposing ends. This attachment is shown in FIGS. 2 and 3. More particularly and as shown in FIG. 3, the upper end of the pole 60 is fitted with an insert 88, the insert being defined by a pair of concentric discs, each disc having teeth on their exterior that engage the interior of the pole when inserted a predetermined length. The insert 88 is press fitted into the upper pole end, the insert having a center opening that receives the end of a fastener 80, such as a carraige bolt, for example, or similar means such that the shank of the fastener extends outwardly therefrom and the head 81 of the fastener engages the insert. The fastener 80 is attached to the insert 88 by means of a nut 84 that is tightened thereupon. The shank of the fastener 80 is inserted through the intermediate panel 66 through opening 70 and capped by means of an appropriate nut 85 and washer 86 combination. Preferably, a nylon locking nut 85 is used, the nut being simply engaged sufficiently to provide attachment but not restrict rotation of the support member. The interface between the intermediate panel and the tube 60 preferably includes a nylon or similar washer 89 or similar means that is introduced therebetween.

Figure 4:
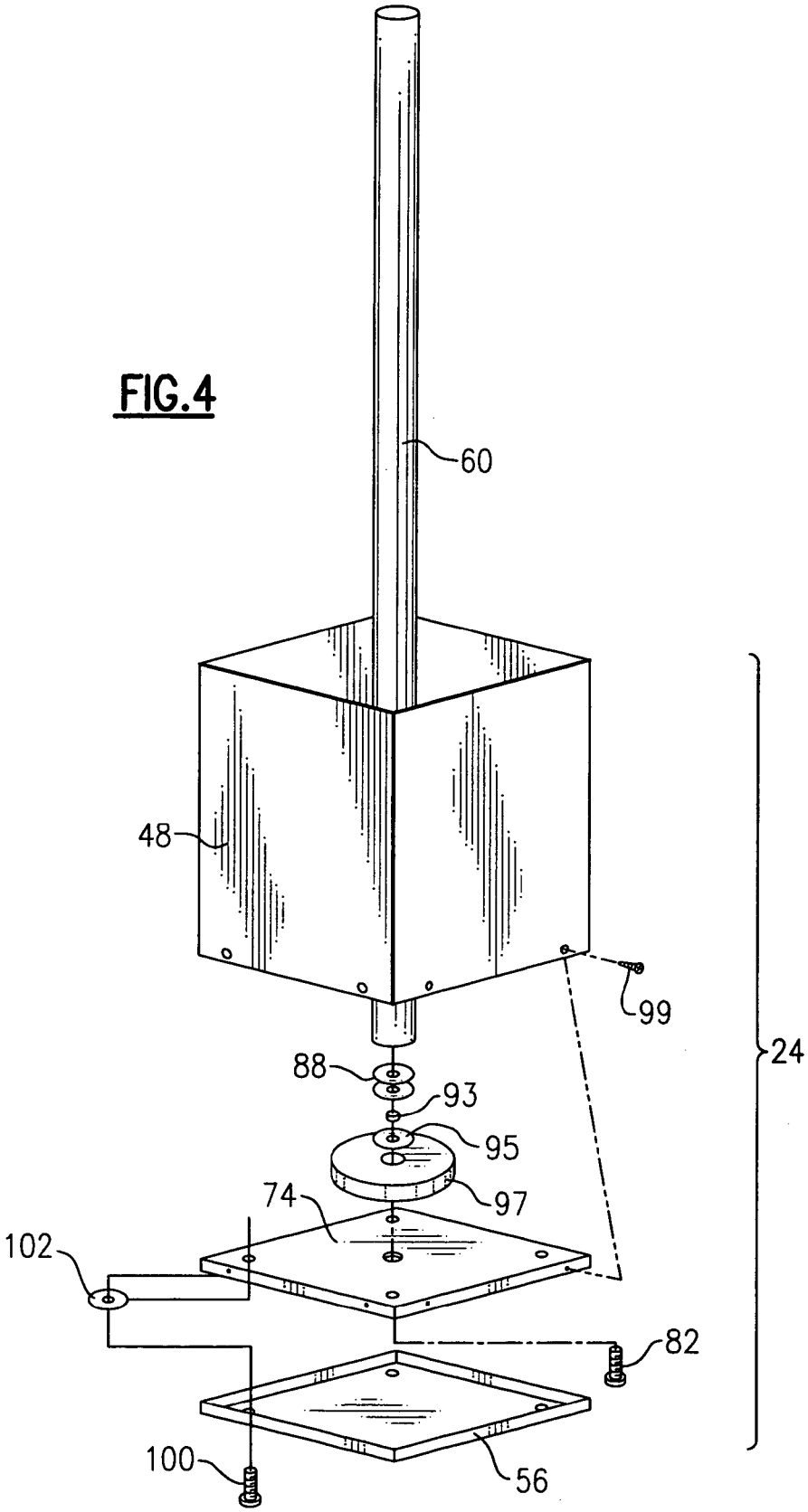
FIG. 4 is an exploded view illustrating the attachment of the vertically extending member relative to the base portion of the display apparatus of FIGS. 1 and 2.

Similarly and referring to FIG. 4, the lower end of the tube 60 is anchored to the base portion 24 of the display apparatus 20, FIG. 2. In this instance, a similar insert 88 to that used in the upper end is fitted within the lower tube end and a fastener 82, such as a carraige bolt or similar form of connection is tightened in place. In this instance, the fastener 82 has a sufficiently long shank such that the remaining end of the fastener, that is, that portion is fitted through the thickness of the lower intermediate panel 74 and optionally through an opening of an interposed counterweight 97. A corresponding nut 93 and washer 95 combination or similar means, is used to tighten the fastener 82 in place and anchor the tube 60 and the counterweight 97 within the apparatus 20. The intermediate lower panel 74 is similarly anchored to the hollow unitary portion 48 of the base section 24, such as using a plurality of flat head screws 99 mounted to the edges of the panel. Each of the top and bottom covers 32, 56 are attached to a corresponding intermediate panel 66, 74, respectively, by means of fasteners 100 that are inserted through openings in the covers and the panels along with threaded T-nuts 102 (only the bottom cover 56 being shown, see FIG. 4) to retain same, though other means can be utilized.

When assembled as described above, the base portion 24 of the herein described apparatus 20 is fixed or stationary, while the support member 28 is freely rotatable about its center axis 64, FIG. 2, due to the securement of the pole 60 at either end to the support member and the base portion, respectively.

Preferably, at least one of the facing side panels 40, 44 of the support member 28 are capable of supporting various forms of graphic media and/or other forms of materials for display. According to this embodiment, one of the lateral side panels 40 is defined by a flat or planar substrate that includes a plurality of transparent plastic sleeves 78 permitting the storage of photographs and/or other graphic media materials. Additional description relating to the transparent sleeves and the display panel are provided in U.S. Ser. No. 10/732,662, filed Dec. 10, 2003, the entire contents of which are incorporated herein by reference. Another lateral or side panel 44 according to this embodiment is depicted as a bulletin board, though any or all of the lateral side panels can alternatively comprise a white board, a calendar board, a magnetic board, or other form of display.

Alternatively, some or all of the lateral side panels do not necessarily have to permit support of graphic media materials and can be used, for example, as advertising or for functional purposes, such as calendaring or scheduling, among others. According to yet another version, at least one of the lateral side panels can open or expand, such as shown in the previously incorporated U.S. Ser. No. 10/732,662 application in order to further maximize available display space, through a hinged or similar configuration. In this version, the side panels can selectively be hinged open in order to expand the available display space for any of the purposes described above.

Figure 5:
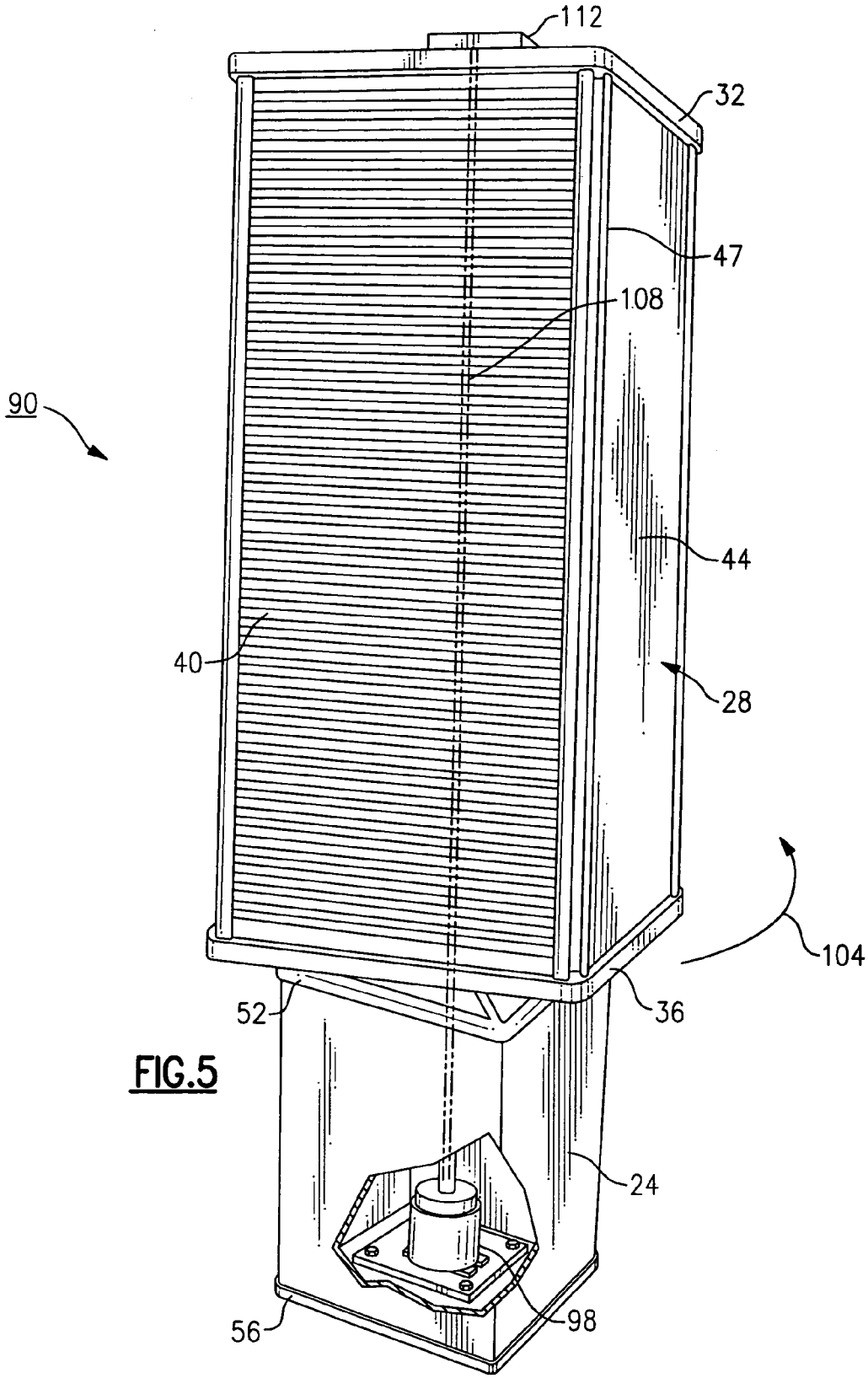
FIG. 5 is a front perspective view of a display apparatus made in accordance with a second embodiment in accordance with the present invention.

Referring to FIG. 5, a display apparatus 90 made in accordance with a second preferred embodiment of the present invention is herein described. Similar parts are herein labeled with the same reference numerals for the sake of clarity.

The display apparatus 90, like the preceding, includes a stationary base portion 24 and a rotatably mounted support member 28 that is mounted for rotation on the top of the stationary base portion. Also as in the preceding, the apparatus 90 further includes a top cover 32, as well as a bottom cover 36 for the rotatable support member 28 and a corresponding top cover 52 and a bottom cover 56 for the stationary base portion 24 as well as a supporting plate (not shown) that is preferably disposed between the top cover and the interior of the support member.

According to this embodiment, a vertically extending pole 60 is mounted through the center axis 64 of the stationary base portion 24 and the support member 28, the pole having a length dimension that projects through the interior of each of the base portion and the support member. The pole 60 is attached, as in the preceding, by means of inserts that are provided at the top and the bottom of the pole, each pole end receiving a fastener that is mounted through a supporting plate. Preferably and as in the preceding, a weight can be added to the interior of the base portion 24 in order to effectively balance the assembly and prevent tipping. According to this embodiment, an electric motor 98 is disposed in the stationary base portion and is attached by conventional means to the pole 60 at the lower end thereof such that the output drive of the motor produces rotational movement of the support member 28 about its center axis 64, as shown by arrow 104 based on the support of the pole 60.

A series of electrical leads 108 are directed or routed through the hollow interior of the pole 60, the leads extending to a light source 112 that is preferably disposed atop the top cover 32 of the herein described apparatus. According to this embodiment, the electrical leads 108 extend through the pole 60, which is stationary. Therefore, the leads 108 are not tangled, pulled or otherwise manipulated as the support member 28 is rotated under the drive force of the electric motor 98. Alternatively, the electrical leads 108 can be used to solely power the light source 112 and the user can manually rotate the support member 28 to effect selective rotation of the apparatus 90, for example using the vertically provided sections 47.

It should be noted herein that the sign illustrated herein is merely exemplary and it should be readily apparent that other configurations can be similarly utilized.

PARTS LIST FOR FIGS. 1–5

20 rotatable display apparatus
24 base portion
28 support member
32 top cover
36 bottom cover
40 lateral side facing panel
44 lateral side facing panel
47 vertically extending sections
48 unitary member
49 slots
50 inwardly cupped portion
52 top cover
56 bottom cover
60 pole
64 center axis
66 intermediate top panel
70 opening
74 intermediate lower panel
78 transparent plastic sleeves
80 fastener
81 head
82 fastener
84 nut
85 nut
86 washer
88 insert
89 nylon washer
90 display apparatus
93 nut
95 washer
97 counterweight
98 motor
99 flat head screws
100 fastener
102 threaded T-nuts
104 arrow
108 electrical leads
112 light source It will be readily apparent that there are many modifications and variations that are possible encompassing the spirit and the scope of the present invention as now recited by the following claims. For example and though not shown, support for the side facing panels could be provided by the pole. That is, the pole can include at least one core section having a square, round or other shape that permits direct attachment of at least one facing panel. Moreover, the panels can be selectively releasable from the at least one core section. According to another variation, the core section can include an interior component and an exterior component that permits rotation relative to the interior component, the pole still allowing electrical leads to be routed through the interior component thereof. In yet another variation, the vertically extending sections can be utilized to receive additional componentry, for example, handles to facilitate rotation of the assembly.

We claim:

1. A rotatable display apparatus comprising:

a base portion;

a display member mounted to said base portion; and a vertically extending support member having means for permitting said display member to be rotated about a center axis of said display apparatus, wherein said vertically extending support member extends through the interior of each of said display member and said base portion and is fixedly attached to a top panel of the display member that distributes the weight thereof;

wherein said display member comprises at least one lateral display panel, for displaying graphic media articles and in which said means for permitting rotation of said display member includes an insert fitted within a hollow upper end of said vertically extending support member, said fitted insert having a center opening for receiving a fastener, a fastener having a shank portion sized to pass entirely through said top panel.

2. Apparatus as recited in claim 1, wherein said at least one vertically extending support member includes means for permitting electrical leads to be routed therethrough.

3. Apparatus as recited in claim 2, wherein said at least one vertically extending support member is hollow.

4. Apparatus as recited in claim 2, wherein said at least one vertically extending support member includes an axial slot sized for receiving said electrical leads.

5. Apparatus as recited in claim 2, including at least one light source connected to electrical leads routed through said at least one vertically extending support member.

6. Apparatus as recited in claim 2, including at least one electric motor.

7. Apparatus as recited in claim 5, wherein said at least one light source is disposed at the top of said display member.

8. Apparatus as recited in claim 7, wherein said light source is disposed within a sign mounted to the top of said display member.

9. Apparatus as recited in claim 5, wherein said light source is disposed in at least one of said base portion and said display member.

10. Apparatus as recited in claim 9, wherein at least a portion of said base portion and said display member are made from a translucent material.

11. Apparatus as recited in claim 1, including at least one electric motor.

12. Apparatus as recited in claim 11, wherein at least one electric motor is disposed in said base portion.

13. Apparatus as recited in claim 11, wherein said at least one electric motor is connected to said display member to effect rotation thereof about said center axis.

14. Apparatus as recited in claim 1, wherein said base portion comprises a unitary open-ended member.

15. Apparatus as recited in claim 14, wherein said unitary open-ended member is formed from a durable plastic.

16. Apparatus as recited in claim 1, wherein said display member includes a plurality of lateral display panels.

17. Apparatus as recited in claim 16, wherein said plurality of lateral display panels is formed in a polyhedral configuration.

18. Apparatus as recited in claim 17, wherein said plurality of display panels include at least one of a white board, a calendar board, a bulletin board and a magnetic board.

19. Apparatus as recited in claim 16, wherein said plurality of lateral display panels are formed in a cubic configuration.

20. Apparatus as recited in claim 1, wherein said base portion is stationary.

21. An apparatus as recited in claim 1, wherein said vertically extending support member is fixedly attached to a bottom panel of said base portion.

22. An apparatus as recited in claim 1, wherein the head of said fastener is disposed in relation to said insert and the end of the shank portion of said fastener extends upwardly through said top panel and is engaged by a nut, said nut being sufficiently engaged to provide attachment but not restrict rotation of said display member about said vertically extending support member.

23. An apparatus as recited in claim 1, wherein the lower end of said vertically extending support member is hollow and includes an insert fitted therein, said insert having an opening sized for receiving a fastener, a fastener having a shank portion which is sufficiently long to pass downwardly through the entirety of said bottom panel.

24. An apparatus as recited in claim 23, wherein the head of said fastener is disposed in relation to said insert and the end of said shank portion of said fastener extends downwardly through said bottom panel, said nut being sufficiently engaged to anchor said member to said base portion.

25. An apparatus as recited in claim 24, including a counterweight provided within said base portion.

26. An apparatus as recited in claim 25, wherein said counterweight is disposed between said bottom panel and said vertically extending support member, said counterweight including an opening through which said fastener passes.

* * * * *

UNITED STATES PATENT AND TRADEMARK OFFICE

CERTIFICATE OF CORRECTION

PATENT NO. : 7,131,619 B2
APPLICATION NO. : 10/834296
DATED : November 7, 2006
INVENTOR(S) : Wallace A. Krapf et al.

It is certified that error appears in the above-identified patent and that said Letters Patent is hereby corrected as shown below:

On Title Page, Item (73)

(73) Assignee: The name "Krapt" is incorrect and should be replaced with --Krapf--.

Signed and Sealed this

Thirteenth Day of February, 2007

JON W. DUDAS
*Director of the United States Patent and Trademark Office*